US006748004B2

(12) United States Patent
Jepson

(10) Patent No.: US 6,748,004 B2
(45) Date of Patent: Jun. 8, 2004

(54) METHODS AND APPARATUS FOR IMPROVED ENERGY EFFICIENT CONTROL OF AN ELECTRIC ARC FURNACE FUME EXTRACTION SYSTEM

(75) Inventor: Stewart C. Jepson, Naperville, IL (US)

(73) Assignee: Air Liquide America, L.P., Houston, TX (US)

( * ) Notice: Subject to any disclaimer, the term of this patent is extended or adjusted under 35 U.S.C. 154(b) by 0 days.

(21) Appl. No.: 10/452,924

(22) Filed: Jun. 3, 2003

(65) Prior Publication Data

US 2004/0017837 A1 Jan. 29, 2004

Related U.S. Application Data

(60) Provisional application No. 60/298,650, filed on Jul. 25, 2002.

(51) Int. Cl.[7] ..... F27D 17/00

(52) U.S. Cl. ..... 373/8; 373/9; 373/77

(58) Field of Search ..... 373/2, 8, 9, 71–73, 373/77–80; 75/10.36, 10.38, 381; 432/72, 120; 110/44, 203, 204, 205, 206, 234, 262

(56) References Cited

U.S. PATENT DOCUMENTS 5,392,312 A * 2/1995 Bernet et al. ..... 373/9
5,590,150 A * 12/1996 Ogushi et al. ..... 373/9
5,999,556 A * 12/1999 Haissig ..... 373/8
6,372,009 B1 * 4/2002 Holmes et al. ..... 75/10.36

* cited by examiner

*Primary Examiner*—Tu Ba Hoang
(74) *Attorney, Agent, or Firm*—Linda K. Russell; Christopher J. Cronin

(57) ABSTRACT

A fume extraction system includes a combustion zone coupled with an exhaust outlet of a furnace to receive an exhaust gas stream emerging from the furnace outlet during system operation, where the exhaust gas stream includes explosive gases that undergo combustion reactions within the combustion zone. A duct section is aligned downstream from the combustion zone to deliver the exhaust gas stream toward a venting outlet. A suction unit establishes a negative pressure within the system so as to draw the exhaust gas stream from the furnace outlet and through the fume extraction system during system operation. An exhaust damper is further provided within the system between the combustion zone inlet and the suction unit. A control system selectively controls the negative pressure applied to the furnace, combustion zone and duct section based upon a measured concentration of at least one gas constituent within the exhaust gas stream.

26 Claims, 1 Drawing Sheet

METHODS AND APPARATUS FOR IMPROVED ENERGY EFFICIENT CONTROL OF AN ELECTRIC ARC FURNACE FUME EXTRACTION SYSTEM

CROSS REFERENCE TO RELATED APPLICATION

This application claims priority from U.S. Provisional Patent Application Serial No. 60/398,650, entitled "Methods and Apparatus for Improved Energy Efficient Control of an Electric Furnace Fume Extraction System" and filed Jul. 25, 2002. The disclosure of the above-mentioned provisional application is incorporated herein by reference in its entirety.

BACKGROUND OF THE INVENTION

1. Technical Field

The present invention pertains to fume extraction systems for furnaces, in particular, electric arc furnaces for melting metals.

2. Discussion of the Related Art

Fume extraction systems are typically utilized in combination with electric arc furnace (EAF) in metals melting and refining installations to capture airborne particulate emissions and to exhaust certain flammable and hazardous gases that evolve during operation of the furnace systems. In particular, gases such as carbon monoxide (CO) and hydrogen ($H_2$) are generated during the melt and refine process and must be properly vented and treated by the fume extraction system to ensure combustion of these gases occurs safely and within a temperature controlled and contained environment. Further, volatile organic compounds (VOC's) may also be generated during the melt process and must also be properly treated to prevent their emission from the ventilation stack to the atmosphere.

A negative pressure or suction is generated within the fume extraction system, via an induced draft (ID) fan, to draw fumes including the previously noted gases and other particulate emissions (e.g., slag or dust) from the EAF into the fume extraction system for treatment therein. The ID fan pulls dust-laden fumes through a bag-house including filters, and then exhausts the filtered gases though a stack and into the atmosphere. Since the fumes exit the EAF at temperatures of up to about 3500° F., the fumes are typically cooled prior to entering the bag-house to temperatures of 200° F. or less using water-cooled ductwork. Dilution air is incorporated to provide cooling of these gases before contacting the bag filters.

A typical EAF melt shop employs a fume extraction system with a number of conduit branches to draw and remove fumes from the EAF and other locations. For example, a conventional fume extraction system may include a conduit branch to collect fumes from one or more ladle metallurgy furnace stations (LMF's), which contribute a small portion of dust emissions to be processed by the fume extraction system, a second conduit branch to suction fumes through a hood or canopy disposed directly above the EAF, and a third branch to suction fumes directly from the "fourth hole" exhaust duct located at the EAF roof. The fourth hole exhaust duct is so named because the roof of an alternating current EAF typically includes three holes for the arc electrodes to extend into the EAF and a "fourth hole" facilitating removal of exhaust gases that evolve during melting of metal within the EAF. The fourth hole exhaust duct is water cooled for much of its length, or at least to lengths where the exhaust gas is expected to exceed about 1200° F.

An air gap is provided in the fourth hole exhaust duct at a location proximate the EAF roof to allow for furnace tilting during tapping of the EAF as well as EAF roof movement to permit opening and charging of the EAF. Air is drawn into this gap by the ID fan during system operation to provide sufficient oxygen within the EAF ventilation duct for burning of combustible gases exiting the EAF. There can be significant concentrations of combustible gases (e.g., as much as 75% on a dry basis), such as CO and $H_2$, in the EAF exhaust. These combustible gases must be safely burned in the downstream water-cooled EAF duct section so as to prevent explosions during system operation and to eliminate or reduce emissions of these species. Accordingly, two main objectives of an EAF fume extraction system are to collect dust and other particulate matter from the fumes in the filters of the bag-house and to safely burn combustible gases emerging from the EAF before these gases enter the bag-house. If the system is not operating properly, fugitive dust emissions can escape the melt shop which could violate air emissions regulations and cause uncomfortable or unsafe working conditions.

Operation of the fume extraction system is controlled with the use of dampers disposed at suitable locations along the canopy, EAF exhaust and LMF exhaust duct sections to modulate suction by these three duct sections. In particular, when the EAF roof is moved to open the EAF during charging (i.e., adding scrap metal to the EAF) or tapping (i.e., removing molten metal from the EAF), the EAF exhaust damper is typically closed or only partially open, and the canopy damper is fully opened to evacuate large bursts of fumes that may be generated (e.g., when dropping a charge bucket into the EAF). During the next batch melt cycle after tapping of the EAF, the canopy damper is typically set to a fixed position, and the EAF exhaust damper is also set to a fixed position or adjusted manually during system operation based upon visual observation of fumes escaping from the furnace roof.

Many EAF shops presently provide little or no automated mechanism for controlling damper operation, and thus the modulation of suction to the branch sections of the fume extraction system, during a batch melt process. Attempts have been made to automate control in a closed loop manner of the EAF duct suction damper by measuring a negative pressure in the furnace or duct with a static pressure tap mounted in the EAF roof, shell, or water-cooled duct section located downstream from the EAF. In essence, the idea is to adjust the EAF exhaust damper so as to continually maintain a certain level of negative pressure in the furnace shell, or in the immediate downstream water-cooled duct section. However, these attempts are rarely effective in practice, because the pressure taps easily become clogged or burn up and thus are not reliable. Even when such pressure control automation does function, it may not provide optimal system operation from an energy efficiency standpoint, as there can be periods during the melt process when too much air is being drawn through the furnace. The alternative is manual adjustment of the EAF exhaust damper, as noted above, in which the operator will set the damper such that a fixed amount of suction will be applied to the EAF throughout a batch melting process. Typically, the operator will open the EAF exhaust damper to make sure that little or no fumes escape the furnace and create a "puffing" effect. This manual adjustment based upon the operator's visual observations of the EAF can lead to reduced energy efficiency (i.e., increased KWH/ton), with a tendency of the operator to err on the side of sucking too hard to minimize "puffing" so as to keep a clean indoor shop environment.

In addition, some EAF shops will also include a variable gap adjustment mechanism at the fourth hole exhaust air gap to modulate the amount of combustion air sucked into this gap. The gap adjustment mechanism includes a sliding, water-cooled sleeve to selectively close portions of the air gap. However, these variable gap systems are bulky and cumbersome, and the sliding sleeve will frequently be rendered inoperative due to the accumulation of slag or debris at the sleeve to limit or prevent its sliding movement.

Thus, there exists a need to provide an improved fume extraction system that is efficient and reliable in extracting fumes and dust from the EAF and ensuring sufficient combustion of gases during a batch melting process, while at the same time minimizing the amount of infiltration air drawn through the EAF at any given time.

OBJECTS AND SUMMARY OF THE INVENTION

Accordingly, it is an object of the present invention to provide a fume extraction system that safely processes and vents exhaust gases generated in a furnace to the environment.

It is another object of the present invention to control the amount of air drawn into the fume extraction system to achieve sufficient combustion of exhaust gases flowing within the system.

It is a further object of the present invention to automate the control of air drawn into the fume extraction system to optimize system performance and efficiency.

The aforesaid objects are achieved individually and/or in combination, and it is not intended that the present invention be construed as requiring two or more of the objects to be combined unless expressly required by the claims attached hereto.

In accordance with the present invention, a fume extraction system is provided including a combustion zone with an inlet that is connectable with an exhaust outlet of a furnace. The combustion zone receives an exhaust gas stream emerging from the furnace outlet during system operation, where the exhaust gas stream includes explosive gases that undergo combustion reactions within the combustion zone. The fume extraction system further includes a duct section aligned downstream from the combustion zone, and a suction unit arranged within the system to establish a negative pressure within the furnace, the combustion zone, and the duct section so as to draw the exhaust gas stream from the furnace outlet and through the combustion zone and duct section during system operation. An adjustable exhaust damper is disposed at a selected location between the inlet of the combustion zone and the suction unit.

A control system is also included that selectively controls the negative pressure applied to the furnace, the combustion zone and the duct section. In particular, the control system includes a gas sensor device disposed at a selected location within the system to measure a concentration of at least one of oxygen, carbon monoxide, hydrogen, carbon dioxide, water vapor and nitrogen within the exhaust gas stream, and a controller in communication with the gas sensor device and the exhaust damper. The controller effects opening and closing of the exhaust damper to selectively modify the negative pressure within the furnace, the combustion zone and the duct section based upon gas concentration measurements received from the gas sensor device. Utilizing this system, a negative pressure can be applied during system operation that is energy efficient and establishes optimal amounts of airflow through the fume extraction system to effectively combust the explosive gases which are exhausted from the furnace. In effect, the system operates to strike a balance by drawing in enough combustion air to ensure safe combustion of all combustible species, while avoiding the drawing of excess EAF infiltration air which reduces furnace electrical energy efficiency.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
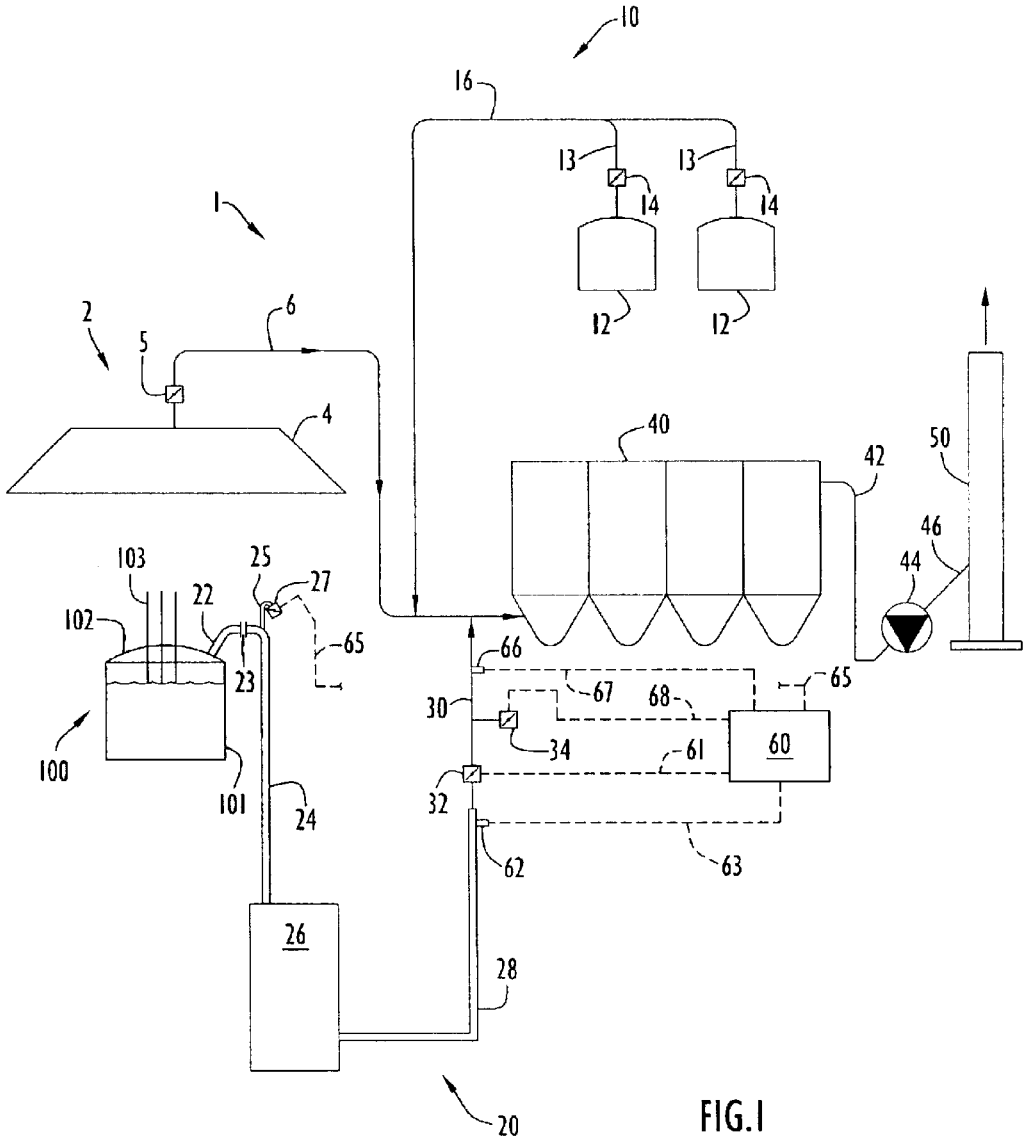
FIG. 1 is a schematic flow diagram of a fume extraction system connected with an electric arc furnace in accordance with the present invention.

During a batch EAF melting process in which exhaust gases are continuously evolving, the characteristics of the furnace gas quantity, composition and temperature, as well as dust loading is continuously changing. For example, early in the batch melt process after charging of the EAF, solid scrap still exists within the furnace and the gases are relatively cool. During this early portion of the melt cycle, typically little or no CO is generated, and dust emission levels are relatively low. In addition, furnace suction is relatively high, because it is easier for the system to suck cold gases through the exhaust duct section in comparison to sucking heated and expanded gases. Accordingly, there are opportunities to reduce suction in the furnace early in the heat to decrease the amount of $O_2$ in the exhaust duct section and provide electrical energy savings.

Later in the process, temperatures become higher and there can be greater quantities of CO generated due to carbon injection and oxygen lancing when implementing one or more oxygen fuel burners and/or lances (e.g., in a conventional and well-known manner). At this stage of the melt cycle, it is more difficult to maintain suction on the EAF, because the heated and expanded gases are more difficult to suction. Dust emissions are also increased due to melting of the scrap metal and $O_2$ lancing. At this stage of the melt cycle, it may be important to increase suction on the EAF to minimize dust emissions and to ensure that enough combustion air infiltrates the EAF exhaust duct section to burn the combustible species present in the exhaust gases.

Fume collection systems are designed and sized with sufficient capacities to handle maximum (peak) gas and dust generation conditions. As described above, suction is typically controlled in the EAF exhaust duct section utilizing an EAF exhaust damper that is maintained in a fixed position to provide maximum suction throughout the heat in a batch melt process. By providing maximum suction within the EAF exhaust duct section throughout the entire EAF batch melt process, the operator can be certain that there are little or no visible fugitive dust emissions and that explosive gases are safely combusted in the water-cooled ductwork. However, utilizing maximum suction throughout the process will also result in excessive amounts of air being drawn through the furnace and the EAF exhaust duct section during much of the melt cycle. This excess air can waste valuable energy. For example, in a 100 ton heat cycle with maximum suction continuously applied to the EAF for over a 60 minute period, 5000 standard cubic feet per minute (SCFM) of air can typically be drawn through the EAF and heated to 3000° F., resulting in an energy loss of 50 KWH/ton.

Optimal control of the canopy and EAF exhaust duct damper positions throughout the batch melt process is clearly desirable to achieve significant electrical energy savings for the process. During much of the heating cycle, there are opportunities to reduce the suction on the EAF exhaust, reducing air infiltration through the furnace. Some level of furnace "puffing" (dust emission fume exhaust) can usually be tolerated, as the canopy will collect these fumes. Some EAF melt shops will apply less suction to the EAF exhaust duct section, creating less of a negative pressure in the EAF, and allow the canopy to collect the subsequent increased level of dust emissions. Melt shops typically attempt to strike a balance between EAF direct suction (i.e., via the EAF exhaust duct) and canopy suction. Typically, shops with less suction (more furnace puffing) can exhibit lower electrical energy consumption levels (KWH/ton).

However, when striking such a balance, EAF direct suction can be too low at certain time periods during the heat cycle. If suction applied to the EAF and EAF exhaust duct section via the EAF exhaust damper is too low at certain time periods, the fugitive dust emission level and CO level in the melt shop can become dangerously high, which can create unsafe conditions for workers and/or lead to outdoor emissions violations. In addition, there is a chance that combustible gases may not have enough oxygen to fully combust in the downstream EAF exhaust ductwork. This can potentially cause explosions or fires downstream from the EAF. Thus, in a fume extraction system with manual damper control, it is easy to see how operators in the EAF melt shop will typically err on the side of drawing excessive amounts of air through the EAF and EAF exhaust ductwork so as to maintain a clean, smoke-free shop environment as well as minimize any of the previously noted potential dangers associated with combustive gases being too far downstream in the EAF exhaust ductwork.

In addition, as noted above, attempts at automating control of the EAF exhaust damper utilizing pressure taps to monitor the negative pressure at or near the EAF have generally not been successful. In addition, even when such automated control functions properly, the negative pressure value does not necessarily lead to optimization of the system, as there still may be periods within the heat cycle when there is excessive air flow through the EAF and EAF exhaust ductwork.

The fume extraction system of the present invention alleviates the previously noted problems and enhances operational efficiency by controlling the amount of air being drawn through the EAF and EAF exhaust duct section throughout a batch melt process based upon a measurement of the amount of one or more gases within the exhaust gas stream at one or more locations within the EAF exhaust duct section of the fume extraction system. In particular, a feedback control system is provided, as described below, to automatically control the EAF exhaust damper and, optionally, other dampers within the fume extraction system based upon measurements of gas constituents within the exhaust gas stream. The measurement of one or more exhaust gas constituents, such as oxygen ($O_2$), carbon monoxide (CO), hydrogen ($H_2$), water vapor ($H_2O$), carbon dioxide ($CO_2$) and/or nitrogen ($N_2$), at certain points within the EAF exhaust ductwork provides an indication as to whether the amount of oxygen flowing in the exhaust gas stream is excessive and/or sufficient to burn the combustive gases, which in turn provides an indication as to whether an adjustment of the airflow drawn into the EAF and/or EAF exhaust duct section is required.

An exemplary embodiment of a fume extraction system with automatic damper control in accordance with the present invention is schematically depicted in FIG. 1. Fume extraction system 1 is connected for operation with an EAF 100. The EAF is an alternating current furnace with a conventional design, including a shell portion 101 to receive and melt scrap metal and a roof 102 with openings for receiving three electrodes 103. Alternatively, it is noted that the EAF may be a direct current furnace including one electrode or any other furnace having any number of electrodes. The electrodes are energized in a conventional and well known manner to generate arc heating within the furnace that is sufficient to convert solid scrap metal into molten metal. An exhaust hole, or fourth hole for an alternating current EAF, is provided in the EAF roof to facilitate connection of an exhaust duct section for drawing fumes from the EAF as described below. The EAF roof is removable from the EAF shell to permit charging of the EAF for a batch melt process. The EAF may further include oxygen fuel burners (not shown) to enhance melting within the EAF during system operation, as well as $O_2$ lances and carbon injection.

System 1 includes a canopy duct section 2, a ladle metal furnace (LMF) duct section 10, and an EAF exhaust duct section 20 which are all combined into a single stream that is delivered to a bag-house 40. The bag-house includes a series of bag filters to remove particulate matter from the exhaust gases being directed through the bag-house. An induced draft (ID) fan 44 is connected, via a vacuum line 42, to an outlet of bag-house 40 and establishes a negative pressure or suction throughout the different duct sections as described below. The ID fan is selected to have a suitable capacity for establishing sufficient levels of suction throughout the various duct sections of the system. In addition, the ID fan may be configured to provide fixed or variable suction during system operation. A positive pressure line 46 is connected between an outlet of ID fan 44 and a stack 50 to permit the flow of processed exhaust gases from the bag-house through the stack and to the surrounding atmosphere. Alternatively, it is noted that the ID fan can be positioned upstream of the bag-house to exert a positive pressure and push the exhaust gases through the bag-house filters toward the stack. Further, any number of ID fans may be positioned at any one or more selected locations throughout the various duct sections of the system to achieve a desired amount of suction through the duct sections.

The canopy duct section includes a hood or canopy 4 disposed above the EAF to receive and vent exhaust fumes emerging from the EAF (e.g., during charging and/or tapping of the EAF, during melting/refining, etc.), and a vacuum line 6 that is connected between canopy 4 and an inlet to bag-house 40. A canopy damper 5 is disposed along vacuum line 6, preferably at a location proximate the canopy. Canopy damper 5 is adjustable and may be of any suitable type (e.g., a butterfly valve) to control the negative pressure applied within vacuum line 6 and, thus, the amount of air and fumes drawn into canopy duct section for processing during system operation.

The LMF duct section includes one or more furnaces 12 connected to a vacuum line 16 that extends to and connects with vacuum line 6 of the canopy duct section at a location upstream of the bag-house inlet. In particular, each furnace 12 includes a conduit section 13 connecting the furnace to vacuum line 16, with an adjustable damper 14 (e.g., a butterfly valve) disposed in each conduit section 13 to facilitate the selective suction of fumes from the furnace into and through the vacuum line during system operation.

The EAF duct section includes a first water cooled exhaust duct section 22 extending from a fourth hole of EAF roof 102 and a second water cooled exhaust duct section 24 extending between the first duct section 22 and a combustion chamber 26. The facing outlet and inlet ends of the respective first and second duct sections are aligned in close proximity with each other to form an air gap 23 within EAF duct section 20. The discontinuity in the EAF duct section at the air gap facilitates the intake of combustion air into the duct as well as movement of the EAF roof during system operation. The air gap is preferably dimensioned to establish a selected amount of air that can be suctioned into the EAF duct section while permitting easy movement of EAF roof 102 with respect to second duct section 24. Both duct sections are further water cooled due to the high temperature of the exhaust gases emerging from the EAF as well as to contain heat that is generated by combustion of the exhaust gases.

Optionally, a water cooled combustion air line 25 is provided and extends from second duct section 24 at a location proximate air gap 23. The combustion air line has a curved or "snorkel" configuration, with an adjustable damper 27 (e.g., a butterfly valve) disposed at its inlet end to permit selected amounts of airflow into the second duct section during system operation. The curved or "snorkel" configuration of combustion air line 25 is oriented with respect to the second duct section such that it resembles an upside-down "J" shape, with its inlet end including damper 27 being directed in a generally downward direction to prevent accumulation of dust or debris at the damper. This configuration further protects damper 27 from direct heat radiation generated from the exhaust gases emerging from the EAF and, as a result of the negative pressure being applied by the ID fan through the EAF duct section, the damper is preferably configured to permit a selected amount of air to be constantly pulled through the combustion air line to maintain the damper at a sufficiently cool temperature.

The "snorkel" combustion air line with adjustable damper enhances the control of air flow into the EAF duct section upstream of the combustion chamber in a way that is easier, more reliable and less expensive than conventional attempts to control air flow through the fourth hole air gap (e.g., via a water cooled sleeve). In addition, it is noted that the cross-sectional area of the combustion air line is sufficiently dimensioned to provide for a sufficient and desirable amount of combustion air flow through the EAF exhaust duct section, in addition to air drawn through the air gap, without being so large as to significantly reduce the amount of suction on the EAF.

Exhaust gases are delivered from the second duct section to an inlet of combustion chamber 26, where further combustion of CO and $H_2$ occurs. The combustion chamber is also referred to as a dropout box because it receives and retains slag and certain other large particulate matter that is entrained with the EAF exhaust gases. Assuming a sufficient amount of oxygen has been provided within the EAF and EAF exhaust duct section upstream of the combustion chamber (e.g., by drawing a suitable amount of air through the EAF and into the EAF exhaust duct section), gases leaving through the outlet of the combustion chamber will be substantially free of CO and $H_2$. A third water cooled duct section 28 extends from the combustion chamber outlet and transitions to a fourth dry (i.e., not water cooled) duct section 30. The fourth duct section merges with canopy vacuum line 6 at a location upstream from the bag-house inlet. Combustion of residual CO and $H_2$ can occur in the third duct section, and the length of the third duct section is selected to ensure sufficient cooling of gases below a threshold temperature (e.g., 1200° F.) prior to entering the fourth dry duct section.

The fourth dry duct section 30 includes an adjustable EAF exhaust damper 32 (e.g., a butterfly valve) and an adjustable dilution air damper 34 (e.g., a butterfly valve) disposed downstream from the EAF exhaust damper. The EAF exhaust damper controls the amount of suction applied by ID fan 44 to EAF 100 and EAF exhaust duct section 20 during system operation. The dilution air damper selectively controls an amount of air to be drawn into duct section 30 to further cool the gases prior to entering bag-house 40.

A feedback control system is provided to effect control of the amount of air suctioned through EAF exhaust duct section 20 by selectively adjusting the EAF exhaust damper and/or any other selected dampers within system 1. In particular, the feedback control system includes a programmable logic controller (PLC) 60 that communicates (e.g., via electrical wiring and/or wireless communication as generally indicated by dashed lines 61 and 63 in FIG. 1) with EAF exhaust damper 32 and a gas sensor device 62 disposed at a selected location between the combustion chamber and the end of the third water cooled exhaust duct section. Preferably, gas sensor device 62 is disposed at a location where combustion of CO and $H_2$ should be substantially complete (e.g., at or near the end of the third water cooled duct section as depicted in FIG. 1).

The gas sensor device includes an oxygen sensor to measure an amount of oxygen remaining in the exhaust gas stream after substantial combustion of CO and $H_2$ has occurred. The oxygen sensor may be of any suitable type (e.g., an in situ probe, a gas extraction sample analyzer, an instantaneous laser diode sensor, etc.) that facilitates measurement of oxygen content within the gas stream. Gas sensor device 62 sends signals corresponding to the oxygen measurements to PLC 60 at a selected rate (e.g., continuously or periodically within the batch melt process), and the PLC determines whether to adjust EAF exhaust damper 32 based upon such signals.

It has been determined that an oxygen content of at least about 5% v/v (i.e., volume oxygen per total volume of exhaust gas on a dry basis) within the exhaust gas stream at locations downstream from combustion chamber 26 provides an indirect indication that the concentrations of CO and $H_2$ in the gas stream are negligible and are at an acceptable level for venting to the atmosphere (e.g., CO and $H_2$ are each below about 1% v/v). In addition, it is desirable to prevent the oxygen content from becoming greater than about 10% v/v within the exhaust gas stream to avoid the application of excess suction and resultant excess airflow through the EAF and EAF exhaust duct section, which in turn increases process energy requirements and decreases EAF efficiency as noted above. In particular, it is preferable to maintain the oxygen content at about 8% v/v within the exhaust gas stream at locations downstream from the combustion chamber.

The PLC controls the airflow through the EAF exhaust duct section, and thus the oxygen content within the exhaust gas stream at locations downstream from the combustion chamber, by adjusting the EAF exhaust damper in accordance with measured signals received from the sensor device. For example, when sensor device 62 measures a percentage value for oxygen within the exhaust gas stream that is below a minimum threshold value (e.g., below about 5% v/v), PLC 60 sends a signal to an actuator disposed on damper 32 to effect partial opening of the damper from a first open position to a second and further open position that increases the suction through the EAF exhaust duct section. The increased suction in turn increases the volume of airflow through the EAF exhaust duct section by drawing a greater amount of air through the EAF, the air gap and/or the combustion air line. Depending upon the sensitivity of the feedback control system (e.g., whether the sensor device continuously sends measurement signals to the PLC, the periods at which the PLC monitors oxygen content, etc.), opening of the EAF exhaust damper may be continuously or periodically adjusted until at least the minimum threshold value for oxygen content in the exhaust gas stream is achieved. Similarly, when the sensor device measures a percentage value for oxygen within the exhaust gas stream that exceeds a maximum threshold value (e.g., above about 10% v/v), PLC 60 sends a signal to the actuator of damper 32 to effect partial closure of the damper until the measured oxygen content within the exhaust gas stream falls to at or below the maximum threshold value. Thus, the feedback control system can achieve airflow control during a batch melt process that renders the process safe in reducing CO and $H_2$ emissions to suitable levels as well as efficient in minimizing excess airflow during a batch melt process.

It is noted that, at certain times during system operation, it may be desirable to maintain or apply further suction through the EAF exhaust duct section even though the $O_2$ content exceeds the maximum threshold value. For example, there may be times when an operator decides that the EAF exhaust damper should be further opened to reduce "puffing" and prevent undesired dust emissions at the EAF. In order to account for such situations, the system may be configured to permit an operator to override PLC control and manually adjust the EAF exhaust damper. Alternatively, exhaust damper control by the PLC may be adjusted according to the specific conditions and needs of a particular melt shop. Thus, any suitable control algorithm may be provided to control selective opening and closing of the EAF exhaust damper based upon concentration measurements of $O_2$ (or any other gas constituents) within the exhaust gas stream as well as any other factors that may be measured and/or visually observed during system operation.

Optionally, the PLC may also effect control over other dampers within the fume extraction system. For example, PLC 60 may communicate with an actuator for combustion air line damper 27 (e.g., via electrical wiring and/or wireless communication as generally indicated by dashed line 65 in FIG. 1) to adjust damper 27 to selected open and closed positions in order to control the amount of combustion air entering EAF exhaust duct section 20. Such automatic control enhances system optimization during periods when it is desirable to selectively control the amount of combustion air flowing into the EAF exhaust duct section without significant modification to the suction or negative pressure applied to the EAF exhaust duct section. In addition, while not shown in FIG. 1, the PLC may further selectively control canopy damper 5 and LMF dampers 14 in a manner similar to that described above for the canopy and EAF exhaust dampers so as to effect partial or complete opening and closing of these dampers during different periods of a batch melt process (e.g., during charging and/or tapping of the EAF, during different stages of a melt cycle, etc.).

Dilution air damper 34 may also be controlled by the PLC to achieve a desired temperature range of the exhaust gases prior to entering the bag-house. As noted above, it is important to sufficiently cool the exhaust gas stream to a suitable temperature level (e.g., to about 200° F. or less) prior to contacting the filters in the bag-house. In particular, system 1 may optionally include a temperature sensor 66 disposed within flow duct 30 at a location downstream from dilution air damper 34. The temperature sensor may be of any suitable type (e.g., RTD, thermocouple, IR, etc.). PLC 60 communicates with temperature sensor 66 and damper 34 (e.g., via electrical wiring and/or wireless communication as generally indicated by dashed lines 67 and 68 in FIG. 1) to facilitate control of the damper based upon temperature measurements by the temperature sensor. The temperature sensor sends signals to the PLC based upon measurements of the exhaust gases flowing within flow duct 30. If the temperature signal is greater than a maximum threshold value, the PLC controls an actuator on damper 34 to effect partial or complete opening of the damper to a position that allows enough dilution air to flow into flow duct 30 so as to cool the exhaust gases to a measured temperature that is within a selected range of the maximum threshold value. Similarly, if the temperature signal is less than a minimum threshold value, the PLC controls the damper actuator to effect partial or complete closure of the air dilution damper until the measured temperature is within a selected range of the minimum threshold value. In this way, the PLC prevents excess dilution air from flowing within the system.

Operation of fume extraction system 1 with EAF 100 is described in relation to a batch melt process. Initially, EAF 100 is charged by opening EAF roof 102 to permit charging of EAF shell 101 with scrap metal. During charging, canopy damper 5 is adjusted, either manually or, alternatively, utilizing PLC 60 as described above, to a selected open position so as to capture fugitive dust and exhaust fumes escaping from the EAF. It is noted that while the EAF roof remains open for charging of the EAF, EAF exhaust damper 32 may be closed or adjusted to a selected open position by PLC 60 to permit limited suction through the EAF exhaust duct section in the charging step.

Once the EAF roof is moved to a closed position on the EAF and charging is complete, PLC 60 adjusts EAF exhaust damper 32 to an initial open position to achieve a suitable amount of suction through the EAF and EAF exhaust duct section 20 via ID fan 44. In particular, infiltration air is drawn through the EAF (e.g., via crevices in the EAF, at the EAF roof seal, and at other locations of the EAF) and combustion air is drawn through air gap 23 and combustion air line 25 and into duct section 24. Combustive gases such as CO and $H_2$ are generated in the EAF during melting of the scrap metal, which are in turn burned by oxygen provided by the air drawn through the EAF and into the EAF exhaust duct section. After charging, the canopy damper is adjusted (e.g., manually or via the PLC) to a selected position that reduces suction through the canopy duct section yet still permits the canopy to capture fugitive exhaust fumes escaping the closed EAF during system operation.

During the heat cycle, when the scrap metal is melting in the EAF shell, the PLC monitors oxygen content of the exhaust gas stream flowing downstream from combustion chamber 26, via measurement signals sent to the PLC by gas sensor device 62, and automatically adjusts EAF exhaust damper 32 to open and closed positions in the manner described above based upon the measured oxygen content. Depending upon changing circumstances during system operation, the PLC may also adjust damper 27 in the combustion air line to increase or decrease airflow into the EAF exhaust duct section. Exhaust gases passing through the combustion chamber are directed into bag-house 40 and through stack 50 to the atmosphere.

The exhaust gases are sufficiently cooled in water cooled duct sections 22, 24 and 28 prior to entering dry duct section 30. Further cooling of the exhaust gases is achieved with dilution air damper 34, with optional control by PLC 60 as described above to ensure enough dilution air is drawn into duct section 30 to maintain the exhaust gases at a maximum threshold temperature prior to entering the bag-house. As a result of the feedback system of the present invention, exhaust gases are safely vented to the atmosphere and contain little amounts or no CO and $H_2$ in accordance with regulatory standards.

Periodically, one or more LMFs 12 may be operated to process molten metal tapped from the EAF. Dampers 14 may be manipulated to selected open positions (e.g., manually or automatically via the PLC) to facilitate suction and removal of exhaust fumes through vacuum line 16 and into bag-house 40. When the EAF is tapped and molten metal is delivered to any of the LMFs, canopy damper 5 may be selectively adjusted (either manually or automatically via the PLC) to achieve a suitable amount of suction through the canopy duct section to capture fumes escaping from the EAF.

While the feedback control system for the fume extraction system described above measures the content of oxygen in the exhaust gas stream downstream from the combustion chamber, it is noted that the sensor device may be configured to measure any one or more gas concentrations within the exhaust gas stream flowing through the EAF exhaust duct section. Further, one or more gas sensor devices may be positioned at any number of different locations within the EAF exhaust duct section and/or within the EAF to measure concentrations of one or more gases at these locations, where each gas sensor device provides measured concentration information of a particular gas or gases to the PLC for analysis and control of one or more dampers within the system. The gas sensor devices utilized with the system of the present invention may measure gas concentrations utilizing any conventional or other techniques, including, without limitation, extractive gas analysis, in situ probe measurement techniques and/or laser based instantaneous measurement techniques. Concentrations of $O_2$, $CO_2$, CO, $H_2$, $H_2O$ and/or $N_2$ may be measured at any one or more selected locations within the EAF exhaust duct section (e.g., within the EAF, at the air gap, in any of the water cooled or dry duct sections, and/or in the combustion chamber) to provide an indication of the amount of air needed to achieve sufficient combustion of explosive gases in the EAF exhaust gas stream at any given time within the batch melt process.

It is noted, for example, that the feedback control system can include a CO sensor to directly measure a percentage of CO in the EAF exhaust gas stream at a downstream location from the combustion chamber. The CO concentration measurement could be utilized by the PLC, alone or in combination with an $O_2$ percentage measurement, to effect control of the EAF exhaust and/or other dampers in the system to ensure appropriate amounts of air are drawn into the EAF exhaust duct section. Further, concentration measurements of $CO_2$ and $O_2$ in the EAF exhaust gas stream at a downstream location could provide additional useful information during system operation. Since the exhaust gases downstream of the combustion chamber should include primarily $N_2$, $CO_2$, and $O_2$, measuring concentrations of both $CO_2$ and $O_2$ will enable calculations of information such as the total amount of airflow through the EAF exhaust duct section, and the ratio of infiltration air entering through the EAF, air gap and/or air combustion line to total exhaust gases emerging from the combustion chamber. Such information can be useful in optimizing system performance.

The system can be further optimized by injecting post combustion oxygen into the EAF to replace the reduced amount of infiltration air drawn through the EAF due to implementation of the feedback control system. The post combustion oxygen burns CO and $H_2$ directly within the furnace more efficiently than the infiltration air (which contains about 79% $N_2$), which in turn will impart more energy into the batch melt process within the EAF and increase overall energy efficiency during system operation.

While the fume extraction system has been described above in combination with an electric arc furnace for melting metal, it is to be understood that the fume extraction system of the present invention can be utilized with any furnace or other system that generates explosive exhaust gases, such as CO and $H_2$, which must be safely consumed in combustion reactions with oxygen such that these gases are in sufficiently small concentrations in the processed gas stream prior to being vented to the atmosphere.

Having described novel methods and apparatus for improved energy efficient control of an electric furnace fume extraction system, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A fume extraction system for containing fumes generated by a furnace, comprising:

a combustion zone including a combustion chamber and an inlet that is connectable with an exhaust outlet of the furnace so as to receive an exhaust gas stream emerging from the furnace outlet, the exhaust gas stream including explosive gases that undergo combustion reactions within the combustion zone;

a duct section aligned downstream from the combustion chamber to deliver the exhaust gas stream toward a system vent outlet;

a suction unit arranged within the system to establish a negative pressure within the furnace, the combustion zone, and the duct section so as to draw the exhaust gas stream from the furnace outlet and through the combustion zone and duct section during system operation;

an adjustable exhaust damper disposed at a selected location within the system between the inlet of the combustion zone and the suction unit; and a control system to selectively control the negative pressure applied to the furnace, the combustion zone and the duct section, the control system comprising:

a gas sensor device disposed at a selected location within the system to measure a concentration of at least one of oxygen, carbon monoxide, hydrogen, carbon dioxide, water and nitrogen within the exhaust gas stream; and a controller in communication with the gas sensor device and the exhaust damper, wherein, during system operation, the controller effects opening and closing of the exhaust damper to selectively modify the negative pressure within the furnace, the combustion zone and the duct section based upon gas concentration measurements received from the gas sensor device.

2. The system of claim 1, wherein the control system includes a plurality of gas sensor devices disposed at selected locations within the system to measure concentrations of at least two different exhaust gas constituents.

3. The system of claim 1, wherein the gas sensor device includes an oxygen sensor to measure the concentration of oxygen in the exhaust gas stream.

4. The system of claim 3, wherein the oxygen sensor is disposed at a location in the system where a majority of the explosive gases within the exhaust gas stream have already undergone combustion reactions, and the controller effects opening and closing of the exhaust damper to increase or decrease the negative pressure within the furnace, the combustion zone, and the duct section so as to maintain an oxygen content within the exhaust gas stream at the location of the oxygen sensor within a selected range of concentration values.

5. The system of claim 4, wherein the controller effects opening of the exhaust damper to increase the negative pressure within the furnace, the combustion zone, and the duct section when the oxygen sensor measures a concentration of oxygen within the exhaust gas stream that is less than about 5% v/v.

6. The system of claim 4, wherein the controller effects partial closure of the exhaust damper to decrease the negative pressure within the furnace, the combustion zone, and the duct section when the oxygen sensor measures a concentration of oxygen within the exhaust gas stream that is greater than about 10% v/v.

7. The system of claim 4, wherein the controller effects opening and closing of the exhaust damper to increase or decrease the negative pressure within the furnace, the combustion zone, and the duct section so as to maintain the oxygen content within the exhaust gas stream at the location of the oxygen sensor at a concentration of about 8% v/v.

8. The system of claim 1, further comprising:

a combustion air line disposed at the combustion zone at a location proximate the furnace outlet, the combustion air line including an adjustable damper to control an amount of airflow through the combustion air line and into the combustion zone.

9. The system of claim 8, wherein the combustion air line includes a curved end extending from a portion of the combustion zone, the adjustable damper of the combustion air line being disposed at the curved end.

10. The system of claim 8, wherein the controller communicates with the combustion air line damper to effect opening and closing of the combustion air line damper during system operation.

11. The system of claim 1, further comprising:

a canopy duct section including a canopy configured for alignment with the furnace to capture exhaust gas emissions escaping from the furnace, and a canopy duct section coupled with the canopy and the suction unit so as to establish a negative pressure within the canopy and canopy duct section during system operation.

12. The system of claim 11, wherein the canopy duct section includes an adjustable damper in communication with the controller, and the controller effects opening and closing of the canopy damper during system operation.

13. An electric arc furnace and fume extraction system comprising:

an electric arc furnace including at least one electrode to provide arc heating within the furnace; and the fume extraction system of claim 1, wherein the inlet of the combustion zone is connected with an exhaust outlet of the electric arc furnace.

14. A method of extracting and processing fumes generated by a furnace utilizing a fume extraction system connected with the furnace, the method comprising:

(a) establishing a negative pressure within the furnace and portions of the fume extraction system, via a suction unit disposed within the fume extraction system, to withdraw an exhaust gas stream from an outlet of the furnace and through the fume extraction system, the exhaust gas stream including explosive gases that undergo combustion reactions within a combustion zone of the fume extraction system;

(b) measuring a concentration of at least one of oxygen, carbon monoxide, hydrogen, carbon dioxide, water and nitrogen within the exhaust gas stream via a gas sensor device disposed at a selected location within the fume extraction system; and (c) automatically modifying the negative pressure within the furnace and portions of the fume extraction system, via a controller, by selectively opening and closing an exhaust damper disposed within the fume extraction system based upon the measured concentration by the gas sensor device.

15. The method of claim 14, wherein a plurality of gas concentrations are measured in (b), and the plurality of measured gas concentrations are utilized to selectively open and close the exhaust damper.

16. The system of claim 14, wherein the gas sensor device includes an oxygen sensor to measure the concentration of oxygen in the exhaust gas stream.

17. The system of claim 16, wherein the oxygen sensor is disposed at a location in the system where a majority of the explosive gases within the exhaust gas stream have already undergone combustion reactions, and (c) includes:

(c.1) selectively opening and closing the exhaust damper, via the controller, to increase or decrease the negative pressure within the furnace and portions of the fume extraction system so as to maintain an oxygen content within the exhaust gas stream at the location of the oxygen sensor within a selected range of concentration values.

18. The method of claim 17, wherein the exhaust damper is selectively opened and closed in (c.1) to increase the negative pressure within the furnace and portions of the fume extraction system when the oxygen sensor measures a concentration of oxygen within the exhaust gas stream that is less than about 5% v/v.

19. The method of claim 17, wherein the exhaust damper is selectively opened and closed in (c.1) to decrease the negative pressure within the furnace and portions of the fume extraction system when the oxygen sensor measures a concentration of oxygen within the exhaust gas stream that is less than about 10% v/v.

20. The method of claim 17, wherein the exhaust damper is selectively opened and closed in (c.1) to increase or decrease the negative pressure within the furnace and portions of the fume extraction system so as to maintain the oxygen content within the exhaust gas stream at the location of the oxygen sensor at a concentration of about 8% v/v.

21. The method of claim 14, further comprising:

(d) facilitating the flow of air into the fume extraction system by providing a combustion air line at a location proximate and downstream from the furnace outlet, the combustion air line including an adjustable damper to control the amount of airflow through the combustion air line and into the fume extraction system.

22. The method of claim 21, wherein the combustion air line includes a curved end extending from a portion of the combustion zone, the adjustable damper of the combustion air line being disposed at the curved end.

23. The method of claim 21, further comprising:

(e) automatically manipulating the combustion air line damper, via the controller, to effect opening and closing of the combustion air line damper.

24. The method of claim 14, further comprising:

(d) capturing exhaust gas emissions escaping from the furnace utilizing a canopy disposed proximate the furnace, wherein the canopy is coupled to the suction unit via a canopy duct section to establish a negative pressure within the canopy and canopy duct section.

25. The method of claim 24, wherein the canopy duct section includes an adjustable damper, and the method further comprises:

(e) automatically manipulating the canopy damper, via the controller, to effect opening and closing of the canopy damper.

26. The method of claim 14, wherein the furnace is an electric arc furnace.

* * * * *